US008274224B2

(12) United States Patent
Gelderland et al.

(10) Patent No.: US 8,274,224 B2
(45) Date of Patent: Sep. 25, 2012

(54) METAL HALIDE LAMP INCLUDING CERAMIC SEALING MATERIAL

(75) Inventors: Sigrid Maria Roman Gelderland, Eindhoven (NL); Theodorus Gerardus Marinus Maria Kappen, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 13/092,407

(22) Filed: Apr. 22, 2011

(65) Prior Publication Data

US 2011/0260610 A1 Oct. 27, 2011

Related U.S. Application Data

(62) Division of application No. 12/377,691, filed on Feb. 17, 2009, now Pat. No. 7,952,285.

(30) Foreign Application Priority Data

Aug. 18, 2006 (EP) ..... 06119148

(51) Int. Cl.
*H01J 17/04* (2012.01)

(52) U.S. Cl. ..... 313/634; 313/631; 313/491

(58) Field of Classification Search ..... 313/631, 313/634, 491, 493; 445/43, 66
See application file for complete search history.

(56) References Cited

U.S. PATENT DOCUMENTS

| | | | | |
|---|---|---|---|---|
| 4,076,991 | A | 2/1978 | Datta | |
| 6,354,901 | B1 | 3/2002 | Bundo | |
| 2002/0180357 | A1 | 12/2002 | Matsuno | |
| 2005/0194908 | A1 * | 9/2005 | Dakin et al. | 315/56 |
| 2006/0008677 | A1 | 1/2006 | Bewlay | |

FOREIGN PATENT DOCUMENTS

| | | | |
|---|---|---|---|
| EP | 0215524 | A1 | 3/1987 |
| EP | 0587238 | A1 | 3/1994 |
| EP | 1482017 | A2 | 12/2004 |
| WO | 2005088675 | A1 | 9/2005 |
| WO | 2005124823 | A1 | 12/2005 |
| WO | 2006046175 | A2 | 5/2006 |

* cited by examiner

*Primary Examiner* — Joseph L Williams

(57) ABSTRACT

A metal halide lamp includes a ceramic discharge vessel and two electrodes. The discharge vessel encloses a discharge volume containing an ionizable gas filling including at least a metal halide, two current lead-through conductors connected to the respective electrodes, and a seal of a sealing material through which at least one of the respective current lead-through conductors issues to the exterior of the discharge vessel. The sealing material of the seal includes a ceramic sealing material including cerium oxide, aluminum oxide and silicon dioxide as a mixture of oxides and/or one or more mixed oxides.

6 Claims, 3 Drawing Sheets

METAL HALIDE LAMP INCLUDING CERAMIC SEALING MATERIAL

FIELD OF THE INVENTION

The present invention relates to a metal halide lamp comprising a ceramic discharge vessel and two electrodes, the discharge vessel enclosing a discharge volume containing an ionizable gas filling comprising at least a metal halide, two current lead-through conductors connected to the respective electrodes, and a seal by means of a sealing material through which the respective current lead-through conductors issue to the exterior of the discharge vessel.

BACKGROUND OF THE INVENTION

Metal halide lamps are known in the art and are described in, for instance, EP215524, EP587238, WO05/088675 and WO06/046175. Such lamps operate under high pressure and comprise ionizable gas fillings of, for instance, NaI (sodium iodide), TlI (thallium iodide), $CaI_2$ (calcium iodide) and $REI_3$. $REI_3$ refers to rare-earth iodides. Characteristic rare-earth iodides for metal halide lamps are $CeI_3$, $PrI_3$, $NdI_3$, $DyI_3$ and $LuI_3$ (cerium, praseodymium, neodymium, dysprosium and lutetium iodide, respectively).

There is a continuous effort in industry to optimize such lamps and their production process. Lifetime and energy-saving aspects of the lamps as well as reduction of costs involved in the production process of the lamp are items that are investigated.

One specific item of interest is the lifetime of the lamp. Substantially long lifetimes are desired, without, however, a substantial change of lamp characteristics.

Another item of interest is, for instance, the reduction of costs during the production process. For instance, lowering the heating temperature during a sealing step in the production process might be of interest in view of saving costs. In the present production process of metal halide lamps, the lamps are sealed at relatively high temperatures. A reduction of heating time and/or heating temperature would be beneficial for the apparatus used for performing such a sealing step, but might also be beneficial for the lifetime of the lamp (less risk of crack formation).

A further specific item of interest is matching the thermal coefficient of expansion of the material of the seal with the material of the current lead-through conductors and/or the material of the discharge vessel. In general, the better the match, the longer the lifetime and/or the less risk of defective lamps in modern lamp production processes of large quantities on an industrial scale. A better match will also reduce the risk of crack formation.

Yet another item of interest is the possibility that the filling constituents (such as mentioned above) within the discharge vessel react with the sealing material and/or that elements in the sealing material have an impact on the filling constituents in the discharge vessel, which processes may have a negative effect on lamp lifetime and/or stability of lamp characteristics.

OBJECT AND SUMMARY OF THE INVENTION

It is an object of the invention to provide an alternative metal halide lamp having preferably improved properties with respect to state-of-the-art metal halide lamps and/or being obtainable by means of an improved production process. It is another object of the invention to provide a metal halide lamp with a seal by means of a sealing material that can be applied in a sealing process at a relatively low temperature and/or with shorter sealing times. It is a further object of the invention to provide a metal halide lamp with a seal by means of a sealing material having a decreased interaction or decreased detrimental interaction with the filling constituents within the discharge vessel.

To this end, the invention provides a metal halide lamp comprising a ceramic discharge vessel and two electrodes, the discharge vessel enclosing a discharge volume containing an ionizable gas filling comprising at least a metal halide, two current lead-through conductors connected to the respective electrodes, and a seal by means of a sealing material through which at least one of the current lead-through conductors issues to the exterior of the discharge vessel, wherein the sealing material of the seal comprises a ceramic sealing material comprising cerium oxide, aluminum oxide (alumina) and silicon dioxide (silica) as a mixture of oxides and/or one or more mixed oxides, wherein the ionizable filling comprises NaI, TlI, $CaI_2$ and $REI_3$ (rare-earth iodide), and wherein the filling comprises at least $CeI_3$.

Both current lead-through conductors are preferably sealed to the discharge vessel. Hence, in a preferred embodiment, the invention provides a metal halide lamp comprising a ceramic discharge vessel and two electrodes, the discharge vessel enclosing a discharge volume containing an ionizable gas filling comprising at least a metal halide, two current lead-through conductors connected to the respective electrodes, and seals by means of a sealing material through which the respective current lead-through conductors issue to the exterior of the discharge vessel, wherein the sealing material of the seals comprises a ceramic sealing material comprising cerium oxide, aluminum oxide (alumina) and silicon dioxide (silica) as a mixture of oxides and/or one or more mixed oxides.

In addition to the advantage of providing an alternative lamp, the lamp with a seal according to the invention has the advantage that the seal is comprised of a material combination which melts at relatively low temperatures, for instance, at lower temperatures than state-of-the-art seals based on dysprosium oxide, aluminum oxide and silicon dioxide, such as described in, for instance, U.S. Pat. No. 4,076,991 and EP0587238, but nevertheless has good properties. Advantageously, the sealing time or the sealing temperature may therefore be reduced, thereby saving costs and material (such as furnaces) and thus significantly reducing the risk of crack formation during the lamp production process. A further advantage is that the sealing material of the seal reduces interaction or detrimental interaction with the filling constituents in the lamp (i.e. in the discharge vessel of the lamp) so that more stable light-technical properties during the lifetime may be provided.

BRIEF DESCRIPTION OF THE DRAWINGS

Embodiments of the invention will now be described, by way of example only, with reference to the accompanying schematic drawings in which corresponding reference symbols indicate corresponding parts, and in which.

DESCRIPTION OF EMBODIMENTS

The lamp of the invention will be described with reference to FIGS. 1 to 3, wherein discharge vessels are schematically depicted and the current lead-through conductors are sealed with two seals, respectively. However, the invention is not limited to such an embodiment. Lamps are known in the art wherein a current lead-through conductor is connected to the discharge vessel in a gastight manner other than by means of a ceramic sealing material, such as, for instance, directly sintered into the discharge vessel. The other current lead-through conductor is sealed with a seal by means of a sealing material. Hence, at least one of the current lead-through conductors is sealed to the discharge vessel with the inventive seal described. Embodiments herein comprise discharge vessels having one or two seals by means of a sealing material of the current lead-through conductors to the discharge vessel according to the invention. Furthermore, for discharge vessels having at least one seal, it holds that the material of the at least one seal is a material according to the invention, i.e. comprises oxides described, i.e. cerium oxide, aluminum oxide and silicon dioxide as a mixture of oxides and/or one or more mixed oxides. In an embodiment, the phrase "the sealing material of the seals" therefore also refers to "the sealing material of at least one of the seals".

Figure 1:
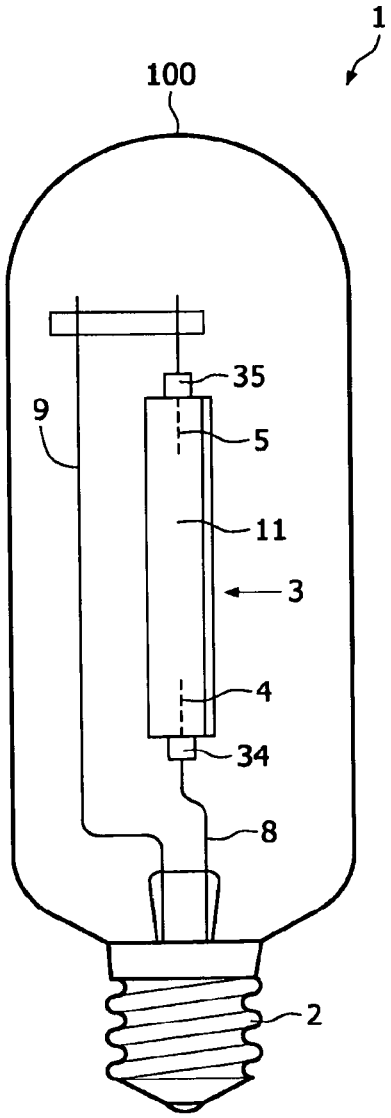
FIG. 1 schematically depicts an embodiment of a lamp according to the invention in a side elevation.
Figure 2:
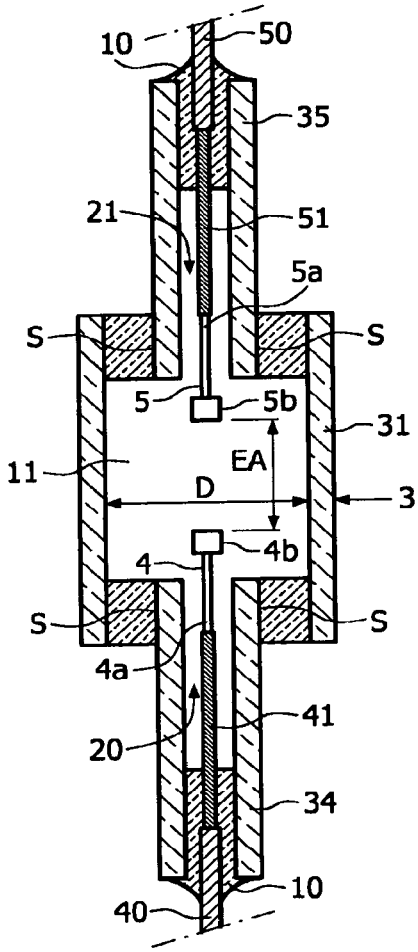
FIG. 2 schematically depicts an embodiment of the discharge vessel of the lamp of FIG. 1 in more detail.
Figure 3:
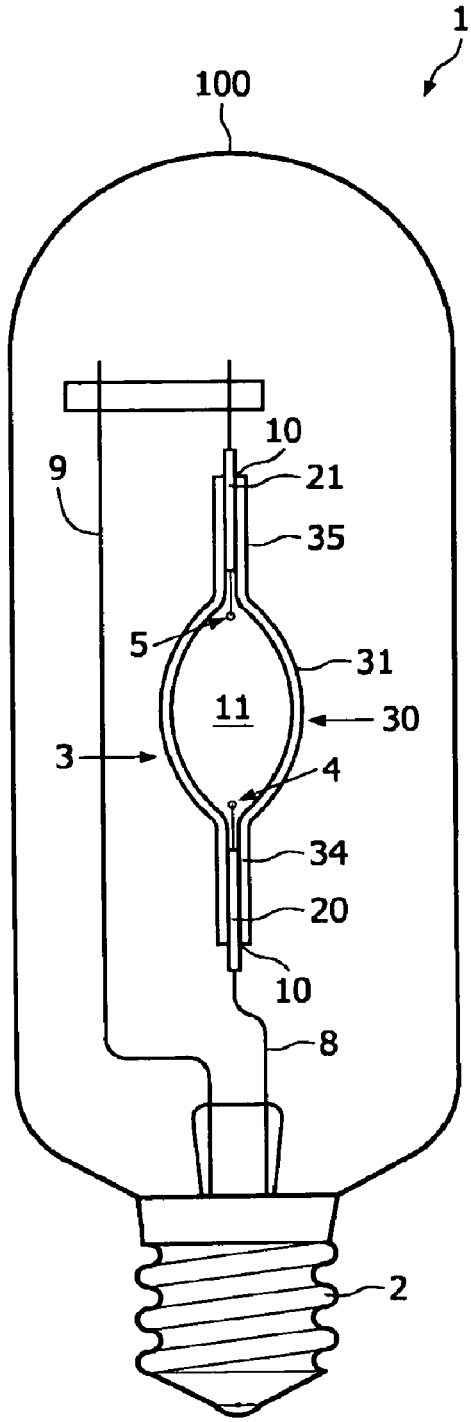
FIG. 3 schematically depicts an embodiment having an alternatively shaped discharge vessel.

Referring to FIGS. 1 to 3, embodiments of a metal halide lamp 1 (not drawn to scale) according to the invention are provided with a discharge vessel 3 having a ceramic wall 31 which encloses a discharge space 11 containing an ionizable filling. The ionizable filling comprises, NaI, TlI, $CaI_2$ and $REI_3$ (rare-earth iodide). $REI_3$ refers to rare-earth iodides such as $CeI_3$, $PrI_3$, $NdI_3$, $DyI_3$, $HoI_3$, $TmI_3$, and $LuI_3$, but also includes Y (yttrium) iodides. Combinations of two or more rare-earth iodides may also be applied. The filling comprises as rare-earth halide at least $CeI_3$. Furthermore, the discharge space 11 may contain Hg (mercury) and a starter gas such as Ar (argon) or Xe (xenon). The ionizable filling may also comprise a rare-earth free ionizable filling, such as a filling comprising NaI, TlI and $CaI_2$. Such fillings are known in the art; the invention is not limited to these ionizable fillings; also other fillings may be applied. Lamp 1 is a high-intensity discharge lamp.).

Two electrodes 4,5, for instance, tungsten electrodes, with tips 4*b*, 5*b* at a mutual distance EA are arranged in the discharge space 11 so as to define a discharge path between them. The discharge vessel has an internal diameter D at least over the distance EA. Each electrode 4,5 extends inside the discharge vessel 3 over a length forming a tip-to-bottom distance between the discharge vessel wall 31 and the electrode tips 4*b*,5*b*. The discharge vessel 3 is closed by means of ceramic protruding plugs 34,35 which enclose current lead-through conductors 20,21 (in general including components 40,41, 50,51, respectively, which are explained in more detail below) to one of the electrodes 4,5 positioned in the discharge vessel 3 with a narrow intervening space and is connected to this conductor in a gastight manner by means of a seal 10 as a melting-ceramic joint formed at an end remote from the discharge space 11.

The discharge vessel is surrounded by an outer bulb 100 which is provided with a lamp cap 2 at one end. A discharge will extend between the electrodes 4,5 when the lamp is operating. The electrode 4 is connected to a first electric contact forming part of the lamp cap 2 via a current conductor 8. The electrode 5 is connected to a second electric contact forming part of the lamp cap 2 via a current conductor 9.

The discharge vessel, shown in more detail in FIG. 2, has a ceramic wall 31 and is generally formed from a cylindrical part with an internal diameter D which is bounded at either end by a respective ceramic protruding plug 34,35 which is fastened in a gastight manner in the cylindrical part by means of a sintered joint S. Each ceramic protruding plug 34,35 narrowly encloses a current lead-through conductor 20,21 of a relevant electrode 4,5 having electrode rods 4*a*, 5*a* which are provided with tips 4*b*, 5*b*, respectively. Current lead-through conductors 20,21 enter discharge vessel 3. Each current lead-through conductor 20,21 comprises a halide-resistant portion 41,51, for instance, in the form of a Mo—$Al_2O_3$ cermet and a portion 40,50 which is fastened to a respective end plug 34,35 in a gastight manner by means of seals 10. Seals 10 extend over some distance, for instance, approximately 1 to 5 mm, over the Mo cermets 41,51 (during sealing, ceramic sealing material penetrates end plugs 34,35, respectively). It is possible for the parts 41,51 to be formed in an alternative manner instead of from a Mo—$Al_2O_3$ cermet. Other possible constructions are known, for instance, from EP0587238, wherein, inter alia, a Mo coil-to-rod configuration is described. The parts 40,50 are made of a metal whose coefficient of expansion corresponds very well to that of the end plugs 34,35. Niobium (Nb) is chosen because this material has a coefficient of thermal expansion corresponding to that of the ceramic discharge vessel 3.

FIG. 3 shows a further preferred embodiment of the lamp according to the invention. Lamp parts corresponding to those shown in FIGS. 1 and 2 are denoted by the same reference numerals. The discharge vessel 3 has a shaped wall 30 enclosing the discharge space 11. In the case shown, the shaped wall 30 forms an ellipsoid. Compared to the embodiment described above (see also FIG. 2), wall 30 is a single entity, in fact comprising wall 31 and respective end plugs 34,35 (shown as separate parts in FIG. 2). A specific embodiment of such a discharge vessel 3 is described in more detail in WO06/046175, which is herein incorporated by reference. Other shapes, such as, for instance, spheroid, are alternatively possible.

The lamps shown in FIGS. 1 to 3 thus have a ceramic discharge vessel, i.e. a discharge vessel with a ceramic wall, which is to be understood to mean a wall of translucent crystalline metal oxide, such as monocrystalline sapphire, and densely sintered polycrystalline alumina (also known as PCA), YAG (yttrium aluminum garnet) and YOX (yttrium aluminum oxide), or translucent metal nitrides such as AlN. In the state of the art, these ceramics are well suited to form translucent discharge vessel walls.

As is known to the person skilled in the art, sealings in this field usually comprise ceramic sealing materials, see, for instance, U.S. Pat. No. 4,076,991 and EP0587238. Such ceramic sealing materials are generally based on a mixture of oxides, which are pressed and sintered into a product in the form of a ring. The production of frit rings and the method of sealing is known to the person skilled in the art.

The oxides (see below) that are used to form the sealing material are mixed, preferably with a binder, and pressed into a desired shape, such as the ring described above. The shape in general is herein further indicated as "ring". The ring is generally subjected to a heat treatment, in order to (pre)sinter the ring and provide a ring that can easily be handled. Sintering is performed by means of methods known to the person skilled in the art. Sintering is preferably performed up to a temperature of about 1300° C., more preferably above about 400° C., and even more preferably above about 1000° C. It may be a two or multistep process, including pre-sintering and sintering. Subsequently, the product is cooled and the ready frit ring is obtained. The ready frit ring comprises a combination of sintered oxides with the combination having preferably a melting point below about 1600° C., more preferably below about 1500° C., even more preferably below about 1400° C., or even below about 1350° C. Comparable state-of-the-art frit rings, especially those based on dysprosium, alumina and silica, have higher melting points. Hence, the frit ring for application on discharge vessel 3 to provide the seal 10 advantageously has a lower melting temperature than state-of-the-art frit rings such as those based on compositions described in EP0587238 and 054076991, especially when compared to frit rings of the art based on similar oxide mixtures (for instance, $Dy_2O_3$, $SiO_2$ and $Al_2O_3$).

The ready frit ring is used to form a seal so as to hermetically seal the current lead-through conductors 20,21 to discharge vessel 3. Seal 10 is applied by heating the frit ring mounted on the exterior ends of protruding end plugs 34,35 and arranged around current lead-through conductors 20,21 to a temperature at which the sealing material melts and the melting-ceramic joint is formed. In general, one of the current lead-through conductors 20,21 is first inserted into ceramic protruding plugs 34,35. Then the frit ring is heated (sealed) and the at least partially liquid (liquefied) material will at least partially penetrate the respective ceramic protruding plugs 34,35, wherein the current lead-through conductor is arranged (see also FIG. 2). Seal 10 is thereby provided. Subsequently, discharge vessel 3 is cooled and filled with the filling constituents, and the other current lead-through conductor is arranged in the other ceramic protruding plug and sealed with ceramic sealing material in the same way as the first current lead-through conductor. The process of forming the seal 10 by means of ceramic sealing material is preferably performed at temperatures between about 1300° C. and 1600° C. This implies that at least part of the frit ring of the oxides formed as a mixture of oxides and/or one or more mixed oxides temporarily achieves this temperature. It has appeared that a high-quality seal is obtained when melting the combination of oxides formed as a mixture of oxides and/or one or more mixed oxides (i.e. when melting the frit) during the sealing process, which results in a good flow behavior (on the ceramic material of the discharge vessel) and consequently the risk on forming cracks during the sealing process is much reduced and thus leading to the observance of substantially crackfree seals as a result.

The ring obtained after pressing and sintering, but before sealing (i.e. before melting the material and hermetically closing discharge vessel 3) is herein indicated as "frit" or "frit ring"; after arranging it on discharge vessel 3, melting and thereby sealing the discharge vessel from the exterior, the product thus obtained at discharge vessel 3 is indicated as seal 10. The sealing material of the seal 10 thus provided to discharge vessel 3 is also indicated as "sealing glass", "ceramic sealing", "ceramic sealing frit", etc.

The materials for the frit ring will now be described in more detail.

Materials for the sealing material combination of oxides (i.e. thus also the starting materials for the frit) are cerium oxide, aluminum oxide and silicon dioxide, and/or oxides based on thereon.

The aluminum oxide used herein is preferably α-alumina. The silicon dioxide used herein is preferably $SiO_2$ (preferably α-quartz (hexagonal according to International Centre for Diffraction Data ICDD 33-1161)). Part (about 1 to 5 wt. %, relative to total weight of the oxides) of the $SiO_2$ material may be replaced by $B_2O_3$. The combination of oxides can be formed as a mixture of oxides and/or one or more mixed oxides. Thus mixed oxides may also be used instead of or in addition to cerium oxide, aluminum oxide and silicon dioxide. In a preferred embodiment, the ceramic sealing material comprises $Ce_2Si_2O_7$ (i.e. $Ce_2O_3.2SiO_2$) (preferably tetragonal (ICDD 48-1588)), and $Al_2O_3$, i.e. as starting material $Ce_2Si_2O_7$ and $Al_2O_3$ are applied instead of cerium oxide, aluminum oxide and silicon dioxide. However, also mixtures of $Ce_2Si_2O_7$ and $Al_2O_3$ and, optionally, cerium oxide and silica may be used. In another embodiment, other mixed oxides may (also) be used, solely or in combination with cerium oxide, aluminum oxide and silica. For instance, $Ce_2SiO_5$ (preferably monoclinic (ICDD 40-0036)), $Ce_2Si_2O_7$ (see above), $Al_6Si_2O_{13}$ (mullite preferably orthorhombic (ICDD 15-0776)) and $CeAlO_3$ (preferably tetragonal (ICDD 48-0051)) may be applied. Hence, in an embodiment, the ceramic sealing material comprises one or more mixed oxides. This implies that the material of seal 10 may comprise one or more mixed oxides. In a preferred embodiment, $Ce_2Si_2O_7$ is used, instead of cerium oxide and silica.

Also other materials for forming the frit may be used which, during sintering under air, form oxides, such as, for instance, cerium metal. The phrase "cerium oxide, aluminum oxide and silicon dioxide" herein also refers to mixtures of, for instance, $Ce_2Si_2O_7$ (and/or other mixed oxides) and $Al_2O_3$. The materials and relative amounts (see below) that are used are based on the relative amounts of the individual oxides as defined below.

In addition to the above-mentioned oxides, also a binder, known to the person skilled in the art, may be added to the mixture of starting materials. During sintering, the binder may be substantially removed from the oxides (during frit ring formation).

The oxides forming the frit, i.e. not taking the presence of the binder into account, preferably comprises 25 to 60 wt. % $Ce_2O_3$, 12 to 64 wt. % $Al_2O_3$ and 3 to 50 wt. % $SiO_2$. Within these ranges, suitable sealing temperatures and flow behavior for a sealing process are obtained. More preferably, the oxides comprises 30 to 57 wt. % $Ce_2O_3$, 20 to 48 wt. % $Al_2O_3$ and 10 to 22 wt. % $SiO_2$ (see also FIG. 4). Such a frit composition especially exhibit a favorable thermal expansion behavior. The weight percentages given here relate to the total amount of oxides that are sintered into a frit ring at a later stage and subsequently sealed onto discharge vessel 3. The weight percentages are independent of the addition of the optional binder. Mixed oxides are calculated as consisting of the basic oxides. For instance, $Al_6Si_2O_{13}$ relates to $3Al_2O_3*2SiO_2$. Within the ranges herein indicated, lamps 1 with good sealings are obtained, exhibiting, for instance, the required lifetimes and technical light properties, and no or acceptable crack behavior, etc. Outside the ranges herein defined, the properties deteriorate.

The invention thus provides a metal halide lamp 1 (high-pressure metal halide lamp 1) comprising discharge vessel 3, wherein discharge vessel 3 (of lamp 1) is further characterized by seals 10 for hermetically sealing current lead-through conductors 20,21 into discharge vessel 3 (i.e. sealing these current lead-through conductors 20,21, especially the parts 40,50 thereof, into discharge vessel 3, i.e. into the end openings of end plugs 34,35) by means of a sealing material wherein the sealing material of seals 10 comprises a ceramic sealing material comprising cerium oxide, aluminum oxide and silicon dioxide as a mixture of oxides and/or one or more mixed oxides as described above.

Discharge vessel 3 comprises an ionizable salt mixture (ionizable gas filling), comprising at least a metal halide. In a preferred embodiment, the metal halide comprises one or more rare-earth halides, preferably cerium halide, more preferably cerium iodide. In a specific embodiment, the ionizable gas filling comprises NaI, TlI, $CaI_2$ and RE-iodide, wherein RE is one or more elements selected from the group comprising rare-earth metals, including Y. RE can thus be formed by a single element or by a mixture of two or more elements. RE is preferably selected from the group comprising Y, La, Ce, Pr, Gd, Tb, Dy, Ho, Er, Tm, Yb, Lu, and Nd. More preferably, RE is selected from the group comprising Ce, Pr and Nd. Especially good light-technical properties and stability are obtained with cerium iodide as rare-earth filling constituent in discharge vessel 3 sealed with the seals 10 herein described. In a further preferred embodiment, the metal halide filling of the discharge vessel is free of any rare-earth halide.

Discharge vessel 3 of metal halide lamp 1 preferably comprises translucent sintered $Al_2O_3$. In an embodiment, the ceramic sealing material comprises 25 to 60 wt. % $Ce_2O_3$, 12 to 64 wt. % $Al_2O_3$ and 3 to 50 wt. % $SiO_2$, i.e. the seal comprises ceramic sealing material comprising cerium oxide, aluminum oxide and silicon dioxide as a mixture of oxides and/or one or more mixed oxides.

EXAMPLES

Figure 4:
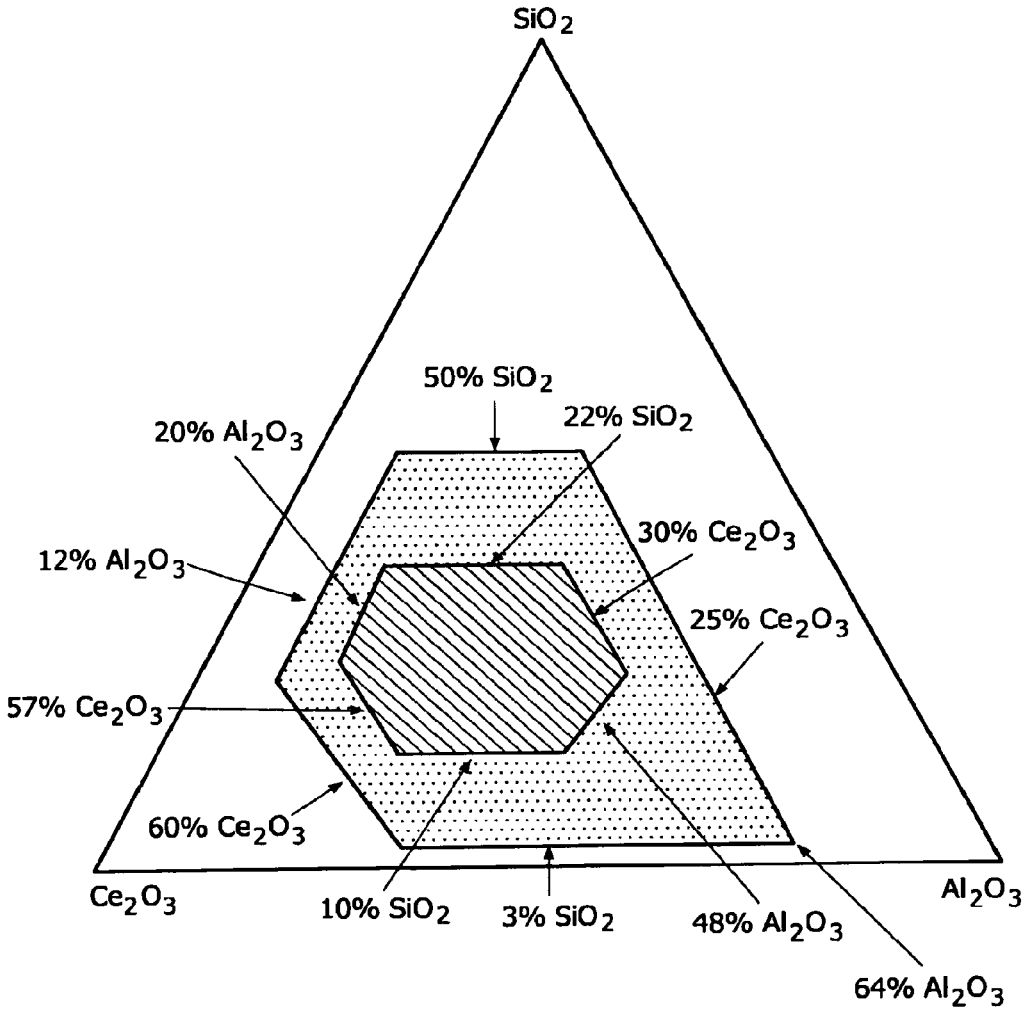
FIG. 4 schematically depicts the working range of the oxides for the ceramic sealing material.

Experiments were performed with a large number of sealing material compositions. Their melting behavior and flow on alumina were studied. Furthermore, a number of lamp experiments were performed with a number of the compositions. FIG. 4 is based on these experiments. Some sealing material compositions and experiments therewith are described in more detail below.

A mixture 1 was made with a weight ratio of $Ce_2O_3$:$Al_2O_3$:$SiO_2$ of 50.3:31.3:18.4; a mixture 2 was made with a weight ratio of $Ce_2O_3$:$Al_2O_3$:$SiO_2$ of 43.6:40.5:15.9; and a mixture 3 was made with a weight ratio of $Ce_2O_3$:$Al_2O_3$:$SiO_2$ of 57.4:35.6:7. Frits comprising these mixtures were made by means of methods known in the art. Discharge vessels 3 were sealed with seals 10, comprising ceramic sealing materials comprising mixtures of oxides 1-3 at a temperature of about 1350° C. (mixture 1), 1400° C. (mixture 2) and 1700° C. (mixture 3).

Example A

Seals 10 were prepared with mixture 1 in PCA end plugs 34,35 with a lead-through conductor comprising a Mo rod and/or coil or a cermet 41,51 (as described above). They showed no initial cracking during manufacture with the sealing material of a seal covering the Mo or cermet up to 7 mm. Neither was any cracking observed upon lamp switching (temperature difference 1100° C.). This indicates a good match of the thermal coefficient of expansion of the sealing material with the materials to which it attaches, i.e. current lead-through conductors 20,21 and the discharge vessel 3, especially ceramic wall 30/protruding plugs 34,35. A thermal coefficient of expansion for at least part of the seal based on mixture 1 of about $9.25*10^{-6}$/K at 800° C. was found.

Example B

In a lamp, mixture 1 was used in sealing PCA plugs 34,35 with Mo lead-through. During lamp operation, the seal has a temperature $T_{seal}$ of about 750° C. Up to 10,000 hours of lamp lifetime was observed without showing significant corrosion. Seal 10 is in contact with salt filling (filing constituents) comprising NaI, $CeI_3$, $TlI_2$, and $CaI_2$.

Example C

When sealing PCA material with mixtures 1 and 2 by raising the temperature until melting, followed by post-heating at a temperature ~100° C. below temperature $T_{flow}$ at which the "frit" flows for a period of 2 to 5 minutes, pure $Al_2O_3$ is formed in the seal.

Advantageously, chemically very resistive seals 10 can be obtained for lamp 1 of the invention. The melting behavior is very suitable: $T_{flow}$ (temperature at which the "frit" flows) is about 1350° C. for mixture 1 and 1400° C. for mixture 2.

Example D

Sealing of Nb in PCA plugs 34,35 with seals 10 by means of sealing material comprising mixture 3 can withstand gas phase iodine up to 1100° C.

It appears that seals 10 of lamp 1 of the invention can be used for sealing lamps with, for instance, NaI and rare-earth iodine and calcium iodine; especially with NaI, $CaI_2$, $TlI_2$, and $CeI_3$ lamp filling. When using PCA plugs with a Mo or cermet lead-through, the best seals 10 are obtained with sealing material having a molar ratio of Ce:Si between 0.9 and 1.1, especially around 1. In that case, the sealing material may comprise a high $Al_2O_3$ content without the melting temperature rising to extreme values. Up to 52 wt % of $Al_2O_3$ is possible and $T_{melt}$<1500° C. An advantage compared to Dy containing sealing material oxide mixtures is that the melting point at similar aluminum oxide contents is lower.

Good results were obtained with $Ce_2Si_2O_7$ as component of sealing materials according to the invention (replacing cerium oxide and silica). Advantageously, when the mixed oxide (bioxide) is used, here $Ce_2Si_2O_7$, the melting temperature may be reduced relative to the melting temperature of a sealing material composition of the mono-oxides (i.e. no mixed oxides). When $Ce_2Si_2O_7$ is used, the melting temperature is reduced by about 50 to 100° C. relative to a mixture of the mono-oxides $SiO_2$ and $Ce_2O_3$.

Based on the experiments, a working area for $Al_2O_3$—$Ce_2O_3$—$SiO_2$ sealing ceramic material is defined in the phase diagram of FIG. 4. Compositions that especially show a good melting behavior and good flow on $Al_2O_3$ are found in the region with the largest area (dark area). Compositions that especially show a good thermal expansion and are useful for sealing $Al_2O_3$ plugs 34,35 with a lead-through with a Mo rod, a Mo-coil or $Al_2O_3$—Mo cermet are found in the smaller region (dashed area). Outside the regions indicated in FIG. 4, the performance is worse. For instance, stability of light-technical properties and maintenance tend to decrease.

In comparison with modern state-of-the-art lamps having conventional features, lamps 1 according to the invention with one or more seals 10 show a similar or better behavior with respect to maintenance and stability of light-technical properties (color point), etc.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "to comprise" and its conjugations does not exclude the presence of elements or steps other than those stated in a claim. The article "a" or "an" preceding an element does not exclude the presence of a plurality of such elements.

The invention claimed is:

1. A metal halide lamp comprising a ceramic discharge vessel and two electrodes, the discharge vessel enclosing a discharge volume containing an ionizable gas filling comprising at least a metal halide, two current lead-through conductors connected to the respective electrodes, and a seal including a sealing material through which at least one of the current lead-through conductors issues to exterior of the discharge vessel, wherein the sealing material of the seal comprises a ceramic sealing material comprising cerium oxide, aluminum oxide and silicon dioxide as a mixture of oxides and/or one or more mixed oxides, wherein the ionizable filling comprises NaI, TlI, $CaI_2$ and $REI_3$ (rare-earth iodide), wherein the filling comprises at least $CeI_3$, and wherein the ceramic sealing material comprises 25 to 60 wt. % $Ce_2O_3$, 12 to 64 wt. % $Al_2O_3$ and 3 to 50 wt. % $SiO_2$.

2. The metal halide lamp according to claim 1, wherein the metal halide comprises one or more rare-earth halides.

3. The metal halide lamp according to claim 1, wherein the metal halide comprises cerium halide.

4. The metal halide lamp according to claim 1, wherein the discharge vessel comprises translucent sintered $Al_2O_3$.

5. A metal halide lamp comprising a ceramic discharge vessel and two electrodes, the discharge vessel enclosing a discharge volume containing an ionizable gas filling comprising at least a metal halide, two current lead-through conductors connected to the respective electrodes, and a seal including a sealing material through which at least one of the current lead-through conductors issues to exterior of the discharge vessel, wherein the sealing material of the seal comprises a ceramic sealing material comprising cerium oxide, aluminum oxide and silicon dioxide as a mixture of oxides and/or one or more mixed oxides, wherein the ionizable filling comprises NaI, TlI, $CaI_2$ and $REI_3$ (rare-earth iodide), wherein the filling comprises at least $CeI_3$, and wherein the ceramic sealing material comprises 30 to 57 wt. % $Ce_2O_3$, 20 to 48 wt. % $Al_2O_3$ and 10 to 22 wt. % $SiO_2$.

6. A metal halide lamp comprising a ceramic discharge vessel and two electrodes, the discharge vessel enclosing a discharge volume containing an ionizable gas filling comprising at least a metal halide, two current lead-through conductors connected to the respective electrodes, and a seal including a sealing material through which at least one of the current lead-through conductors issues to exterior of the discharge vessel, wherein the sealing material of the seal comprises a ceramic sealing material comprising cerium oxide, aluminum oxide and silicon dioxide as a mixture of oxides and/or one or more mixed oxides, wherein the ionizable fillinq comprises NaI, TlI, $CaI_2$ and $REI_3$ (rare-earth iodide), wherein the filling comprises at least $CeI_3$, and wherein the sealing material has a melting point below 1400° C.

* * * * *